US010561877B2

(12) United States Patent
Workman

(10) Patent No.: US 10,561,877 B2
(45) Date of Patent: Feb. 18, 2020

(54) DROP-IN PIVOT CONFIGURATION FOR STATIONARY BIKE

(71) Applicant: ICON Health & Fitness, Inc., Logan, UT (US)

(72) Inventor: Ryan Workman, Logan, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 119 days.

(21) Appl. No.: 15/787,430

(22) Filed: Oct. 18, 2017

(65) Prior Publication Data

US 2018/0117383 A1 May 3, 2018

Related U.S. Application Data

(60) Provisional application No. 62/415,941, filed on Nov. 1, 2016.

(51) Int. Cl.

| | |
|---|---|
| ***A63B 21/00*** | (2006.01) |
| ***A63B 22/06*** | (2006.01) |
| ***A63B 24/00*** | (2006.01) |
| ***A63B 22/00*** | (2006.01) |
| ***A63B 21/22*** | (2006.01) |

(Continued)

(52) U.S. Cl.

CPC .... *A63B 21/00069* (2013.01); *A63B 22/0023* (2013.01); *A63B 22/0605* (2013.01); *A63B 24/0087* (2013.01); *A63B 21/005* (2013.01); *A63B 21/00192* (2013.01); *A63B 21/225* (2013.01); *A63B 71/0622* (2013.01); *A63B 2022/0611* (2013.01); *A63B 2225/093* (2013.01); *A63B 2225/682* (2013.01)

(58) Field of Classification Search

CPC ..... A63B 21/00069; A63B 21/225; A63B 21/005; A63B 21/00192; A63B 22/0023; A63B 22/0605; A63B 24/0087; A63B 71/0622; A63B 2022/0611; A63B 2225/682

See application file for complete search history.

(56) References Cited

U.S. PATENT DOCUMENTS

| | | | |
|---|---|---|---|
| 1,577,866 | A | 3/1926 | Mossberg |
| 2,041,445 | A | 5/1936 | Warren |

(Continued)

FOREIGN PATENT DOCUMENTS

| | | |
|---|---|---|
| CN | 103363001 | 10/2015 |
| JP | 10167158 | 6/1998 |

(Continued)

OTHER PUBLICATIONS

International Search Report issued in PCT/US2017/057405 dated Jan. 19, 2018.

(Continued)

*Primary Examiner* — Megan Anderson
*Assistant Examiner* — Kathleen Vermillera
(74) *Attorney, Agent, or Firm* — Ray Quinney & Nebeker

(57) ABSTRACT

An exercise machine may include a frame. The frame may include a base portion, an upright portion coupled to the base portion, and a pivot joint connecting the upright portion to the base portion. The pivot joint may include a drop-in axle connected to the upright portion and a drop-in receptacle connected to the base portion. The drop-in axle may be removably received in the drop-in receptacle.

19 Claims, 7 Drawing Sheets

(51) Int. Cl.
*A63B 21/005* (2006.01)
*A63B 71/06* (2006.01)

(56) References Cited

U.S. PATENT DOCUMENTS 3,008,265 A 11/1961 Converse
3,100,640 A 8/1963 Weitzel
3,103,357 A 9/1963 Berne
3,190,675 A 6/1965 Chun-Yi
3,205,888 A 9/1965 Stroop
3,227,447 A 1/1966 Baker
3,323,366 A 6/1967 De Lorme, Jr. et al.
3,425,523 A 2/1969 Robinette
3,432,164 A 3/1969 Deeks
3,506,311 A 4/1970 Nobach
3,528,653 A 9/1970 Stuckenschneider et al.
3,563,541 A 2/1971 Sanquist
3,572,700 A 3/1971 Mastropaolo
3,621,948 A 11/1971 Dimick
3,686,776 A 8/1972 Dahl
3,820,617 A 6/1974 Groff
3,833,216 A 9/1974 Philbin
3,903,613 A 9/1975 Bisberg
3,966,201 A 6/1976 Mester
3,967,503 A 7/1976 Svensson
3,990,136 A 11/1976 Hishida
4,007,927 A 2/1977 Proctor
4,045,096 A 8/1977 Lidov
4,049,262 A 9/1977 Cunningham, Jr.
4,138,286 A 2/1979 Chevrolat et al.
4,148,478 A 4/1979 Moyski et al.
4,151,988 A 5/1979 Nabinger
4,188,030 A 2/1980 Hooper
4,208,921 A 6/1980 Keyes
4,278,095 A 7/1981 Lapeyre
4,286,696 A 9/1981 Szymski et al.
4,290,601 A 9/1981 Mittelstadt
4,291,872 A 9/1981 Brilando et al.
4,505,473 A 3/1985 Pro
4,512,567 A 4/1985 Phillips
4,519,604 A 5/1985 Arzounian
4,533,136 A 8/1985 Smith et al.
4,588,232 A 5/1986 Kim et al.
4,589,656 A 5/1986 Baldwin
4,602,781 A 7/1986 La Marsh et al.
4,611,807 A 9/1986 Castillo
4,625,962 A 12/1986 Street
4,630,817 A 12/1986 Buckley
4,637,605 A 1/1987 Ritchie
4,645,199 A 2/1987 Bloemendaal
4,702,475 A 10/1987 Elstein et al.
4,709,917 A 12/1987 Yang
4,711,447 A 12/1987 Mansfield
4,720,099 A 1/1988 Carlson
4,720,789 A 1/1988 Hector et al.
4,726,582 A 2/1988 Fulks
4,741,578 A 5/1988 Viellard
4,743,009 A 5/1988 Beale
4,746,112 A 5/1988 Fayal
4,762,317 A 8/1988 Camfield et al.
4,786,069 A 11/1988 Tang
4,826,150 A 5/1989 Minoura
4,867,443 A 9/1989 Jensen
4,887,967 A 12/1989 Letovsky et al.
4,898,379 A 2/1990 Shiba
4,900,017 A 2/1990 Bold, Jr.
4,917,376 A 4/1990 Lo
4,917,377 A 4/1990 Chen
4,925,183 A 5/1990 Kim
4,932,651 A 6/1990 Defaux
4,938,474 A 7/1990 Sweeney et al.
4,938,475 A 7/1990 Sargeant
4,958,832 A 9/1990 Kim
4,977,794 A 12/1990 Metcalf
4,981,294 A 1/1991 Dalebout et al.
5,000,440 A 3/1991 Lynch
5,016,870 A 5/1991 Bulloch et al.
5,033,736 A * 7/1991 Hirschfeld ..... A61H 1/0214 482/57
RE33,662 E 8/1991 Blair et al.
5,062,633 A 11/1991 Engel et al.
5,081,991 A 1/1992 Chance
5,104,119 A 4/1992 Lynch
5,137,501 A 8/1992 Mertesdorf
5,139,255 A 8/1992 Sollami
5,161,652 A 11/1992 Suzuki
5,162,029 A 11/1992 Schine
5,171,196 A 12/1992 Lynch
5,178,589 A 1/1993 Wilson
5,234,392 A 8/1993 Clark
5,240,417 A 8/1993 Smithson et al.
5,242,343 A 9/1993 Miller
5,247,853 A 9/1993 Dalebout
5,261,864 A 11/1993 Fitzpatrick
5,277,678 A 1/1994 Friedebach et al.
5,299,997 A 4/1994 Chen
5,302,161 A 4/1994 Loubert et al.
5,324,242 A 6/1994 Lo
RE34,728 E 9/1994 Hall-Tipping
5,358,461 A 10/1994 Bailey, Jr.
5,362,069 A 11/1994 Hall-Tipping
5,372,564 A 12/1994 Spirito
5,374,227 A 12/1994 Webb
5,383,715 A 1/1995 Homma et al.
5,409,435 A 4/1995 Daniels
RE34,959 E 5/1995 Potts
5,417,643 A 5/1995 Taylor
5,419,619 A 5/1995 Lew
5,423,729 A 6/1995 Eschenbach
5,431,612 A 7/1995 Holden
5,435,798 A 7/1995 Habing et al.
5,462,503 A 10/1995 Benjamin et al.
5,503,043 A 4/1996 Olbrich
5,512,029 A 4/1996 Barnard
5,514,053 A 5/1996 Hawkins et al.
5,529,554 A 6/1996 Eschenbach
5,533,951 A 7/1996 Chang
5,542,503 A 8/1996 Dunn et al.
5,577,985 A 11/1996 Miller
5,580,249 A 12/1996 Jacobsen et al.
5,584,700 A 12/1996 Feldman et al.
5,584,779 A 12/1996 Knecht
5,591,104 A 1/1997 Andrus et al.
5,611,756 A 3/1997 Miller
5,626,401 A 5/1997 Terry, Sr. et al.
5,656,001 A 8/1997 Baatz
5,665,031 A 9/1997 Hsieh
5,665,032 A 9/1997 Chen
5,667,459 A 9/1997 Su
5,669,833 A 9/1997 Stone
5,685,804 A 11/1997 Whan-Tong et al.
5,690,582 A 11/1997 Ulrich et al.
5,692,994 A 12/1997 Eschenbach
5,695,435 A * 12/1997 Dalebout ..... A63B 21/0083 482/57
5,708,355 A 1/1998 Schrey
5,709,631 A 1/1998 Kleinsasser
5,709,632 A 1/1998 Socwell
5,762,584 A 6/1998 Daniels
5,772,522 A 6/1998 Nesbit
5,782,639 A 7/1998 Beal
5,785,630 A 7/1998 Bobick et al.
5,788,609 A 8/1998 Miller
5,795,270 A 8/1998 Woods et al.
5,810,696 A 9/1998 Webb
5,826,898 A 10/1998 Fortier et al.
5,833,583 A 11/1998 Chuang
5,836,855 A 11/1998 Eschenbach
5,839,990 A 11/1998 Virkkala
5,848,954 A 12/1998 Stearns et al.
5,862,892 A 1/1999 Conley
5,868,108 A 2/1999 Schmitz et al.
5,878,479 A 3/1999 Dickerson et al.
5,884,735 A 3/1999 Eckel et al.

(56) References Cited

U.S. PATENT DOCUMENTS 5,888,172 A 3/1999 Andrus et al.
5,890,995 A 4/1999 Bobick et al.
5,895,339 A 4/1999 Maresh
5,897,460 A 4/1999 McBride et al.
5,913,751 A 6/1999 Eschenbach
5,916,064 A 6/1999 Eschenbach
5,917,692 A 6/1999 Schmitz et al.
5,921,896 A 7/1999 Boland
5,938,551 A 8/1999 Warner
5,938,570 A 8/1999 Maresh
5,947,824 A 9/1999 Minami et al.
5,967,944 A 10/1999 Vittone et al.
5,984,839 A 11/1999 Corkum
5,989,161 A 11/1999 Wang et al.
5,989,163 A 11/1999 Rodgers, Jr.
5,991,143 A 11/1999 Wright et al.
6,003,481 A 12/1999 Pischinger et al.
6,014,913 A 1/2000 Masahiro
6,017,295 A 1/2000 Eschenbach
6,039,676 A 3/2000 Clive
6,045,488 A 4/2000 Eschenbach
6,053,847 A 4/2000 Stearns et al.
6,075,525 A 6/2000 Hsieh
6,090,014 A 7/2000 Eschenbach
6,126,573 A 10/2000 Eschenbach
6,142,870 A 11/2000 Wada et al.
6,142,913 A 11/2000 Ewert
6,142,915 A 11/2000 Eschenbach
6,164,423 A 12/2000 Dickerson
6,182,531 B1 2/2001 Gallagher et al.
6,183,397 B1 2/2001 Stearns et al.
6,186,290 B1 2/2001 Carlson
6,210,305 B1 4/2001 Eschenbach
6,217,486 B1 4/2001 Rosenow
6,224,080 B1 5/2001 Ross
6,234,938 B1 5/2001 Chen
6,244,988 B1 6/2001 Delman
6,254,514 B1 7/2001 Maresh et al.
6,280,362 B1 8/2001 Dalebout et al.
6,312,363 B1 11/2001 Watterson et al.
6,361,476 B1 3/2002 Eschenbach
6,361,477 B1 3/2002 Kolda
6,397,797 B1 6/2002 Kolmanovsky et al.
6,416,442 B1 7/2002 Stearns et al.
6,419,611 B1 7/2002 Levine et al.
6,422,976 B1 7/2002 Eschenbach
6,447,424 B1 9/2002 Ashby et al.
6,450,923 B1 9/2002 Vatti
6,454,679 B1 9/2002 Radow
6,458,060 B1 10/2002 Watterson et al.
6,482,128 B1 11/2002 Michalow
6,482,132 B2 11/2002 Eschenbach
6,497,426 B2 12/2002 Vanpelt
6,505,503 B1 1/2003 Teresi et al.
6,530,864 B1 3/2003 Parks
6,544,146 B1 4/2003 Stearns et al.
6,547,702 B1 4/2003 Heidecke
6,569,061 B2 5/2003 Stearns et al.
6,572,511 B1 6/2003 Volpe
6,592,502 B1 7/2003 Phillips
6,604,008 B2 8/2003 Chudley et al.
6,612,969 B2 9/2003 Eschenbach
6,626,802 B1 9/2003 Rodgers, Jr.
6,647,826 B2 11/2003 Okajima et al.
6,648,353 B1 11/2003 Cabal
6,648,800 B2 11/2003 Stearns et al.
6,681,728 B2 1/2004 Haghgooie
6,689,019 B2 2/2004 Ohrt et al.
6,695,694 B2 2/2004 Ishikawa et al.
6,702,719 B1 3/2004 Brown et al.
6,712,737 B1 3/2004 Nusbaum
6,752,453 B1 6/2004 Yapp
6,758,790 B1 7/2004 Ellis
6,786,821 B2 9/2004 Nobe et al.
6,786,848 B2 9/2004 Yamashita et al.
6,786,850 B2 9/2004 Nizamuddin
6,793,609 B1 9/2004 Fan
6,796,927 B2 9/2004 Toyama
6,824,502 B1 11/2004 Huang
6,835,166 B1 12/2004 Stearns et al.
6,840,892 B1 1/2005 Wu
6,846,272 B2 1/2005 Rosenow et al.
6,887,190 B1 5/2005 Azari
6,902,513 B1 6/2005 Mcclure
6,902,515 B2 6/2005 Howell et al.
6,908,417 B2 6/2005 Jackson
6,910,991 B2 6/2005 Matsumoto
6,910,992 B2 6/2005 Arguilez
6,918,859 B1 7/2005 Yeh
6,918,860 B1 7/2005 Nusbaum
6,926,645 B1 8/2005 Stearns
6,926,646 B1 8/2005 Nguyen
6,932,745 B1 8/2005 Ellis
6,945,917 B1 9/2005 Baatz
6,994,656 B2 2/2006 Liao et al.
7,008,173 B2 3/2006 Gabrys et al.
7,009,613 B2 3/2006 Goden
7,022,047 B2 4/2006 Cohen et al.
7,022,048 B1 4/2006 Fernandez
7,033,269 B2 4/2006 Namba et al.
7,037,241 B2 5/2006 Kuo
7,044,891 B1 5/2006 Rivera
7,060,006 B1 6/2006 Watterson et al.
7,083,546 B2 8/2006 Zillig
7,101,330 B2 9/2006 Elbaz et al.
7,141,008 B2 11/2006 Krull et al.
7,166,062 B1 1/2007 Watterson et al.
7,166,064 B2 1/2007 Watterson et al.
7,166,067 B2 1/2007 Talish et al.
7,169,088 B2 1/2007 Rodgers, Jr.
7,169,089 B2 1/2007 Rodgers, Jr.
7,172,531 B2 2/2007 Rodgers, Jr.
7,201,705 B2 4/2007 Rodgers, Jr.
7,201,707 B1 4/2007 Moon
7,214,168 B2 5/2007 Rodgers
7,244,217 B2 7/2007 Rodgers, Jr.
7,278,955 B2 10/2007 Giannelli et al.
7,292,151 B2 11/2007 Ferguson
7,303,508 B2 12/2007 Toyama et al.
7,303,510 B2 12/2007 Gebhardt
7,319,457 B2 1/2008 Lin et al.
7,322,907 B2 1/2008 Bowser
7,335,135 B2 2/2008 Wang
7,341,542 B2 3/2008 Ohrt et al.
7,352,365 B2 4/2008 Trachte
7,364,533 B2 4/2008 Baker
7,369,121 B2 5/2008 Lane
7,375,450 B2 5/2008 Tanaka et al.
7,393,308 B1 7/2008 Huang
7,402,145 B1 7/2008 Woggon
7,410,449 B2 8/2008 Yeh
7,422,548 B1 9/2008 Teng
7,462,134 B2 12/2008 Lull et al.
7,491,154 B2 2/2009 Yonehana et al.
7,530,932 B2 5/2009 Lofgren et al.
7,549,947 B2 6/2009 Hickman et al.
7,572,205 B1 8/2009 Cribar
7,575,537 B2 8/2009 Ellis
7,585,258 B2 9/2009 Watson et al.
7,594,878 B1 9/2009 Joannou
7,594,879 B2 9/2009 Johnson
7,645,215 B2 1/2010 Gordon
7,648,446 B2 1/2010 Chiles et al.
7,682,286 B2 3/2010 Badarneh et al.
7,682,287 B1 3/2010 Hsieh
7,695,406 B2 4/2010 Waters
7,704,192 B2 4/2010 Dyer et al.
7,708,670 B2 5/2010 Bowser
7,731,635 B2 6/2010 Dyer
7,749,137 B2 7/2010 Watt et al.
7,753,824 B2 7/2010 Wang
7,758,469 B2 7/2010 Dyer et al.
7,766,797 B2 8/2010 Dalebout
7,771,325 B2 8/2010 Baker

(56) References Cited

U.S. PATENT DOCUMENTS 7,780,577 B2 8/2010 Arnold
7,803,096 B2 9/2010 Mehta
7,815,549 B2 10/2010 Crawford et al.
7,825,319 B2 11/2010 Turner
7,837,595 B2 11/2010 Rice
7,841,964 B2 11/2010 Radow
7,850,537 B2 12/2010 Stern
7,862,476 B2 1/2011 Radow
7,862,483 B2 1/2011 Hendrickson et al.
7,867,146 B2 1/2011 Ge et al.
7,871,355 B2 1/2011 Yeh
7,874,615 B2 1/2011 Huyck
7,887,465 B2 2/2011 Uffelman
7,918,768 B2 4/2011 Rogozinski
7,935,027 B2 5/2011 Graber
7,963,889 B2 6/2011 Badarneh et al.
7,967,709 B2 6/2011 Emura
8,002,684 B2 8/2011 Laurent
8,007,422 B2 8/2011 Zaccherini
8,012,003 B2 9/2011 Sterchi et al.
8,012,067 B2 9/2011 Joannou
8,029,415 B2 10/2011 Ashby et al.
8,047,965 B2 11/2011 Shea
8,057,366 B2 11/2011 Schippers
8,062,190 B2 11/2011 Pyles et al.
8,063,776 B2 11/2011 Ruha
8,103,517 B2 1/2012 Hinnebusch
8,105,213 B2 1/2012 Stewart et al.
8,109,858 B2 2/2012 Redmann
8,113,990 B2 2/2012 Kolman et al.
8,123,527 B2 2/2012 Holljes
8,241,182 B2 8/2012 Julskjaer et al.
8,241,186 B2 8/2012 Brodess et al.
8,260,858 B2 9/2012 Belz et al.
8,306,635 B2 11/2012 Pryor
8,485,945 B2 7/2013 Leonhard
8,585,561 B2 11/2013 Watt et al.
8,647,240 B2 2/2014 Heidecke
8,734,157 B1 5/2014 Hummel, III
8,786,575 B2 7/2014 Miller
8,801,578 B2 8/2014 Corbalis et al.
8,827,871 B2 9/2014 Golesh
8,834,323 B2 9/2014 Chen
8,845,493 B2 9/2014 Watterson et al.
8,876,669 B2 11/2014 Vujicic
8,939,831 B2 1/2015 Dugan
8,990,732 B2 3/2015 Farrenkopf et al.
8,996,978 B2 3/2015 Richstein et al.
9,011,291 B2 4/2015 Birrell
9,039,581 B2 5/2015 Chia et al.
9,044,635 B2 6/2015 Lull
9,084,565 B2 7/2015 Mason et al.
9,088,450 B2 7/2015 Jung et al.
9,108,081 B2 8/2015 Giannelli et al.
9,114,276 B2 8/2015 Bayerlein et al.
9,148,077 B2 9/2015 Henderson
9,162,106 B1 10/2015 Scheiman
9,174,085 B2 11/2015 Foley
9,198,622 B2 12/2015 Kaleal et al.
9,227,103 B2 1/2016 Yang
9,275,504 B1 3/2016 Cooper
9,278,249 B2 3/2016 Watterson
9,330,544 B2 5/2016 Levesque et al.
9,358,418 B2 6/2016 Golesh
9,358,422 B2 6/2016 Brontman
9,367,668 B2 6/2016 Flynt et al.
9,389,718 B1 7/2016 Letourneur
9,452,320 B2 9/2016 Yang
9,468,794 B2 10/2016 Barton
9,517,812 B2 12/2016 Tetsuka
9,566,469 B1 2/2017 Rector
9,579,534 B2 2/2017 Sutkowski et al.
9,586,085 B2 3/2017 Arnold et al.
9,623,286 B1 4/2017 Chen
9,707,443 B2 7/2017 Warren
9,750,343 B2 9/2017 McBride et al.
9,757,611 B1 9/2017 Colburn
9,782,625 B1 10/2017 Blum et al.
9,827,458 B2 11/2017 Dalton
9,845,133 B2 12/2017 Craven et al.
9,886,458 B2 2/2018 Jung et al.
9,950,209 B2 4/2018 Yim et al.
9,981,153 B2 5/2018 Chou
9,987,513 B2 6/2018 Yim et al.
9,990,126 B2 6/2018 Chanyontpatanakul
9,999,818 B2 6/2018 Hawkins, III et al.
10,004,945 B2 6/2018 Sauter
2001/0001303 A1 5/2001 Ohsuga et al.
2001/0031686 A1* 10/2001 Ware ..... A63B 21/015 482/57
2002/0055422 A1 5/2002 Airmet
2003/0073545 A1 4/2003 Liu
2003/0148853 A1 8/2003 Alessandri
2003/0171190 A1 9/2003 Rice
2004/0023761 A1 2/2004 Emery
2004/0180719 A1 9/2004 Feldman
2004/0224740 A1 11/2004 Ball et al.
2005/0049117 A1 3/2005 Rodgers
2005/0143226 A1 6/2005 Heidecke
2005/0245370 A1 11/2005 Boland
2005/0264112 A1 12/2005 Tanaka et al.
2006/0063644 A1 3/2006 Yang
2006/0122035 A1 6/2006 Felix
2006/0128533 A1 6/2006 Ma
2006/0194679 A1 8/2006 Hatcher
2006/0240947 A1 10/2006 Qu
2006/0264286 A1 11/2006 Hodjat
2006/0287089 A1 12/2006 Addington et al.
2007/0038137 A1 2/2007 Arand et al.
2007/0042868 A1 2/2007 Fisher
2007/0049467 A1 3/2007 Lin
2007/0111858 A1 5/2007 Dugan
2007/0123390 A1 5/2007 Mathis
2007/0142183 A1 6/2007 Chang
2007/0161467 A1 7/2007 Lee
2007/0190508 A1 8/2007 Dalton
2007/0197345 A1 8/2007 Wallace et al.
2007/0225119 A1 9/2007 Schenk
2007/0238584 A1 10/2007 Lee
2007/0270726 A1 11/2007 Chou
2007/0281828 A1 12/2007 Rice
2007/0298935 A1 12/2007 Badarneh
2007/0298937 A1 12/2007 Shah
2008/0020907 A1 1/2008 Lin
2008/0026838 A1 1/2008 Dunstan et al.
2008/0032864 A1 2/2008 Hakki
2008/0103024 A1 5/2008 Habing
2008/0108917 A1 5/2008 Joutras et al.
2008/0139370 A1 6/2008 Charnitski
2008/0207407 A1 8/2008 Yeh
2008/0214971 A1 9/2008 Talish
2008/0242511 A1 10/2008 Munoz et al.
2008/0269025 A1 10/2008 Badarneh et al.
2008/0279896 A1 11/2008 Heinen et al.
2008/0293488 A1 11/2008 Cheng et al.
2009/0118098 A1 5/2009 Yeh
2009/0128516 A1 5/2009 Rimon et al.
2009/0221405 A1 9/2009 Wang
2009/0221407 A1 9/2009 Hauk
2010/0035726 A1 2/2010 Fisher et al.
2010/0064255 A1 3/2010 Rottler et al.
2010/0077564 A1 4/2010 Saier et al.
2010/0081548 A1 4/2010 Labedz
2010/0210418 A1 8/2010 Park
2010/0240458 A1 9/2010 Gaiba et al.
2010/0311552 A1 12/2010 Sumners
2011/0017168 A1 1/2011 Gilpatrick
2011/0143769 A1 6/2011 Jones et al.
2011/0172059 A1* 7/2011 Watterson ..... A63B 22/02 482/5
2011/0281694 A1 11/2011 Vujicic et al.
2012/0071301 A1* 3/2012 Kaylor ..... A63B 21/00058 482/57
2012/0088640 A1 4/2012 Wissink

(56) References Cited

U.S. PATENT DOCUMENTS

| | | | | |
|---|---|---|---|---|
| 2012/0178592 | A1 | 7/2012 | Chieh | |
| 2012/0322625 | A1 | 12/2012 | Park | |
| 2013/0061714 | A1 | 3/2013 | Hsiung | |
| 2013/0228063 | A1 | 9/2013 | Turner | |
| 2013/0237383 | A1 | 9/2013 | Chen | |
| 2013/0346043 | A1 | 12/2013 | Mewes et al. | |
| 2014/0087923 | A1 | 3/2014 | Warren | |
| 2014/0123325 | A1 | 5/2014 | Jung et al. | |
| 2014/0274564 | A1 | 9/2014 | Greenbaum | |
| 2015/0004579 | A1 | 1/2015 | Shelton | |
| 2015/0045190 | A1* | 2/2015 | Keiser | A63B 21/0051 482/57 |
| 2015/0177083 | A1 | 6/2015 | Redmond | |
| 2015/0182781 | A1 | 7/2015 | Watterson | |
| 2015/0209617 | A1 | 7/2015 | Hsiao | |
| 2015/0290490 | A1 | 10/2015 | Badarneh | |
| 2016/0263426 | A1 | 9/2016 | Mueller et al. | |
| 2016/0346595 | A1 | 12/2016 | Dalebout et al. | |
| 2017/0036053 | A1 | 2/2017 | Smith et al. | |
| 2017/0259111 | A1 | 9/2017 | Hsieh | |
| 2017/0312580 | A1 | 11/2017 | Chang | |
| 2017/0319906 | A1 | 11/2017 | Chang et al. | |
| 2018/0117383 | A1 | 5/2018 | Workman | |
| 2018/0117393 | A1 | 5/2018 | Ercanbrack | |
| 2018/0200566 | A1 | 7/2018 | Weston | |
| 2019/0178313 | A1 | 6/2019 | Wrobel | |

FOREIGN PATENT DOCUMENTS

| | | | |
|---|---|---|---|
| KR | 20110001324 | * | 2/2011 |
| KR | 101499823 | * | 3/2015 |
| TW | 407113 | | 10/2000 |
| TW | M245969 | * | 10/2004 |
| TW | I264321 | | 10/2006 |
| TW | M442167 | * | 12/2012 |
| TW | I579197 | | 4/2017 |

OTHER PUBLICATIONS

Webpage: https://www.proform.com/exercise-bikes/tour-de-france-pro-5-bike updated Aug. 22, 2016.

English translation of Search Report and Office Action issued in Taiwan Patent Application No. 106133333 dated Apr. 19, 2018.

International Search Report and Written Opinion issued in application PCT/US2017/057405 dated Jan. 19, 2018.

International Search Report and Written Opinion issued in application PCT/US2018/013626 dated May 10, 2018.

English Translation of Office Action and Search Report issued in Taiwan Patent Application No. 107143798 dated Aug. 22, 2019.

* cited by examiner

DROP-IN PIVOT CONFIGURATION FOR STATIONARY BIKE

RELATED APPLICATIONS

This application claims priority to U.S. Patent Application Ser. No. 62/415,941 titled "Drop-in Pivot Configuration for Stationary Bike" and filed on 1 Nov. 2016, which application is herein incorporated by reference for all that it discloses.

BACKGROUND

Aerobic exercise is a popular form of exercise that improves one's cardiovascular health by reducing blood pressure and providing other benefits to the human body. Aerobic exercise generally involves low intensity physical exertion over a long duration of time. Generally, the human body can adequately supply enough oxygen to meet the body's demands at the intensity levels involved with aerobic exercise. Popular forms of aerobic exercise include running, jogging, swimming, and cycling, among others activities. In contrast, anaerobic exercise often involves high intensity exercises over a short duration of time. Popular forms of anaerobic exercise include strength training and short distance running.

One popular form of aerobic exercise is cycling. Cycling is typically done on stationary bikes indoors or on moving bikes outside that travel off road or on streets. With a traditional upright bicycle, the user rests his or her body weight entirely on a small portion of the bike's seat, handles, and pedals. With an upright bike, the user typically leans forward as he or she pedals. Another form of cycling is recumbent cycling. With a recumbent bicycle, the user is often reclined in a seat with a back support which distributes the user's weight over a larger area, including the user's back.

One type of cycling is disclosed in U.S. Pat. No. 6,497,426 issued to James L. Vanpelt, et al. In this reference, a bicycle provides a frame having forward and rear frame portions that selectively attach and detach from each other in upright and recumbent positions. In the upright position, cranks are connected to a gear box that is adapted to drive a typical chain sprocket. In the recumbent position, the cranks are removed from the rear gear box and are attached to a forward gear box. A drive shaft is positioned between the gear boxes so that the bicycle rider may power the bicycle from the forward gear box. The bicycle may also be configured to be used as a tandem with a second set of cranks attached to the rear gear box. Other types of cycling devices are disclosed in U.S. Pat. No. 6,648,353 to Pedro Pablo Cabal and U.S. Patent Publication No. 2013/0260964 issued to Benjamin Chia, the disclosures of which are incorporated herein by reference, for all that they disclose.

SUMMARY

In one embodiment, an exercise machine includes a frame. The frame includes a base portion, an upright portion coupled to the base portion, and a pivot joint connecting the upright portion to the base portion. The pivot joint includes an drop-in axle connected to the upright portion and a drop-in receptacle connected to the base portion. The drop-in axle is removably received in the drop-in receptacle.

The exercise machine may include a movable element that moves with respect to the frame during the performance of an exercise.

The movable element may include a crank assembly connected to the upright portion. The crank assembly may include a crank axle, a first crank arm attached to a first side of the crank axle, and a second crank arm attached to a second side of the crank axle.

The exercise machine may include a housing that covers at least a portion of the crank axle. The drop-in axle may be located outside of the housing.

The crank axle may be independent of the drop-in axle.

The exercise machine may include a flywheel that resists movement of the movable element during the performance of the exercise.

The exercise machine may include a tilt actuator that connects the base portion of the frame to the upright portion of the frame and determines an angle that the upright portion forms with respect to the base portion.

The flywheel may be located on a far side of the exercise machine away from the tilt actuator and is a counter weight to the tilt actuator.

The upright portion of the frame may be pivotable about the drop-in axle. The upright portion may have a pivot range that is within negative 20 degrees and positive 20 degrees.

The exercise machine may be a stationary bicycle.

The drop-in axle may be located on a distal end of the upright portion.

The drop-in receptacle may be a slide bracket.

The base portion may include a horizontal frame member and the drop-in receptacle is mounted directly to the horizontal frame member.

The exercise machine may include a wheel attached to the horizontal frame member.

The upright portion may include a seat frame member, and the console frame member may be connected to the seat frame member. The seat frame member and the console frame member may form a Y shape.

In one embodiment, the exercise machine may include a frame. The frame may include a base portion, an upright portion coupled to the base portion, and a pivot joint connecting the upright portion to the base portion. The pivot joint may include an drop-in axle connected to the upright portion and a drop-in receptacle connected to the base portion. The drop-in axle may be removably received in the drop-in receptacle. The exercise machine may include a movable element that moves with respect to the frame during the performance of an exercise. The movable element may include a crank assembly connected to the upright portion. The crank assembly may include a crank axle, a first crank arm attached to a first side of the crank axle, and a second crank arm attached to a second side of the crank axle.

The exercise machine may include a flywheel that resists movement of the movable element during the performance of the exercise.

The exercise machine may include a tilt actuator that connects the base portion of the frame to the upright portion of the frame and determines an angle that the upright portion forms with respect to the base portion.

The flywheel may be located on a far side of the exercise machine away from the tilt actuator and is a counter weight to the tilt actuator.

In one embodiment, an exercise machine includes a frame. The frame includes a base portion, an upright portion coupled to the base portion, and a pivot joint connecting the upright portion to the base portion. The pivot joint may include an drop-in axle connected to the upright portion and a drop-in receptacle connected to the base portion. The drop-in axle may be removably received in the drop-in receptacle. The exercise machine may include a movable element that moves with respect to the frame during the performance of an exercise. The movable element may include a crank assembly connected to the upright portion. The crank assembly may include a crank axle, a first crank arm attached to a first side of the crank axle, and a second crank arm attached to a second side of the crank axle. The exercise machine may include a flywheel that resists movement of the movable element during the performance of the exercise and a tilt actuator that connects the base portion of the frame to the upright portion of the frame and determines an angle that the upright portion forms with respect to the base portion. The flywheel may be located on a far side of the exercise machine away from the tilt actuator and is a counter weight to the tilt actuator.

BRIEF DESCRIPTION OF THE DRAWINGS

The accompanying drawings illustrate various embodiments of the present apparatus and are a part of the specification. The illustrated embodiments are merely examples of the present apparatus and do not limit the scope thereof.

Throughout the drawings, identical reference numbers designate similar, but not necessarily identical, elements.

DETAILED DESCRIPTION

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. Often, the width of an object is transverse the object's length. Furthermore, for the purposes of this disclosure, the term "drop-in receptacle" generally refers to a receptacle that is constructed to receive a complementary object for attachment by lowering the object into the receptacle.

Figure 1:
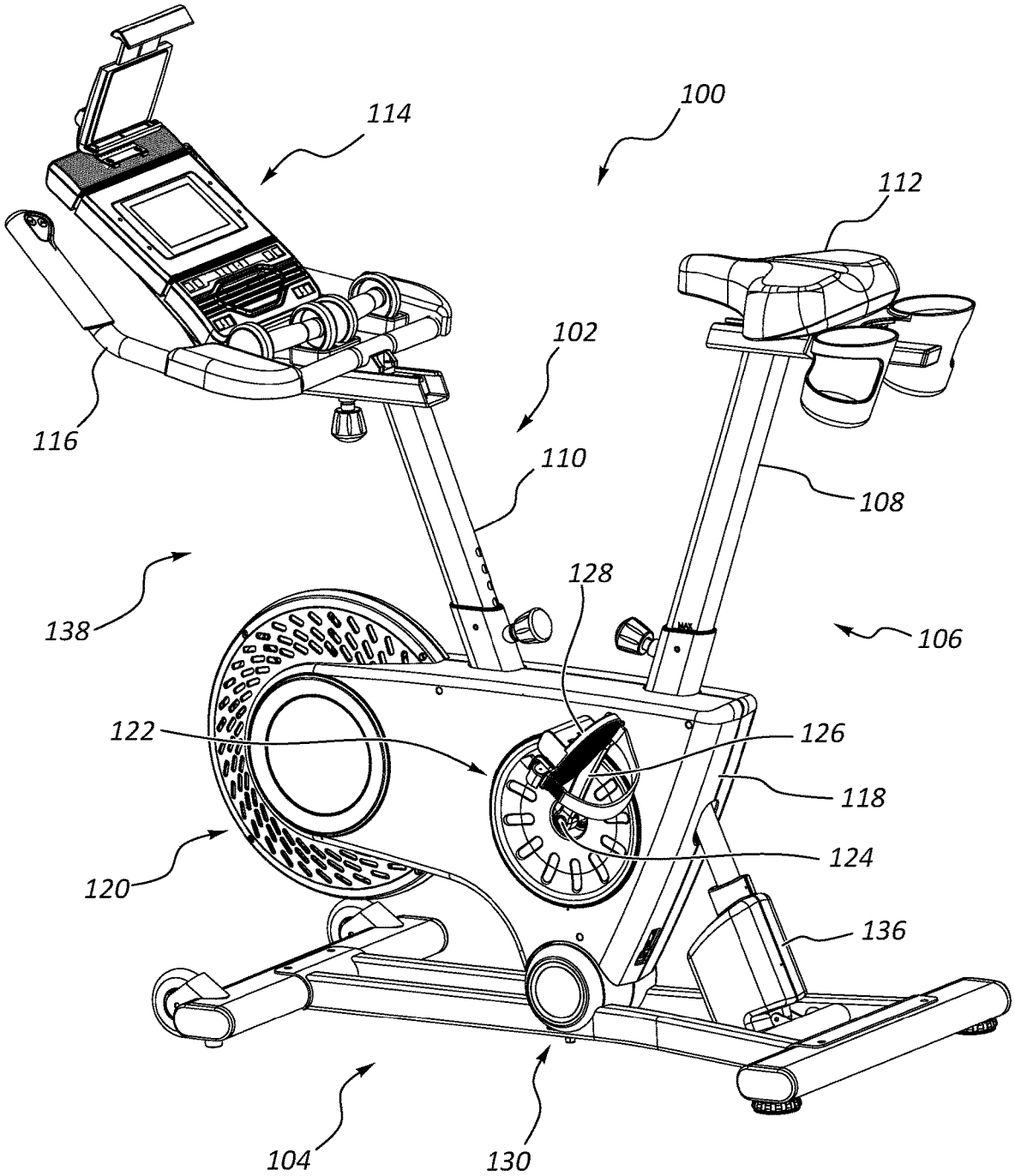
FIG. 1 illustrates a side view of an example of an exercise machine in an upright cycling mode accordance with the present disclosure.

Particularly, with reference to the figures, FIG. 1 depicts an example of an exercise machine 100. The exercise machine 100 includes a frame 102 with a base portion 104 and an upright portion 106. The upright portion 106 of the frame 102 includes a seat member 108 and a console member 110. A seat 112 is attached to the seat member 108, and a console 114 is attached to the console member 110. In this example, a handle 116 is attached to the console member 110.

At least a portion of the upright portion 106 of the frame 102 is covered by a housing 118 that hides at least some of the internal components of the exercise machine 100. In this example, a rotary resistance mechanism 120 is disposed in the housing 118 and is attached to a crank assembly 122 (e.g., a movable element). In this example, the rotary resistance mechanism 120 includes a flywheel and a magnetic unit positioned proximate the flywheel that resists the movement of the flywheel. The crank assembly 122 includes a crank axle 124 connected to a first crank arm 126 and a second crank arm (not shown). During the performance of an exercise on the exercise machine 100, a user pushes against a first pedal 128 connected to the first crank arm 126 and a second pedal (not shown) connected to the second crank arm.

The upright portion 106 of the frame 102 is connected to the base portion 104 of the frame 102 at a pivot joint 130. The pivot joint 130 includes an drop-in axle (216, FIG. 2) that is removably attached to a drop-in receptacle (218, FIG. 2). A tilt actuator 136 connects the base portion 104 of the frame 102 to the upright portion 106 of the frame 102. The rotary resistance mechanism 120 is located on a far side 138 of the exercise machine 100 away from the tilt actuator 136 and is a counter weight on the other side of the pivot joint 130 to the tilt actuator 136.

Figure 2:
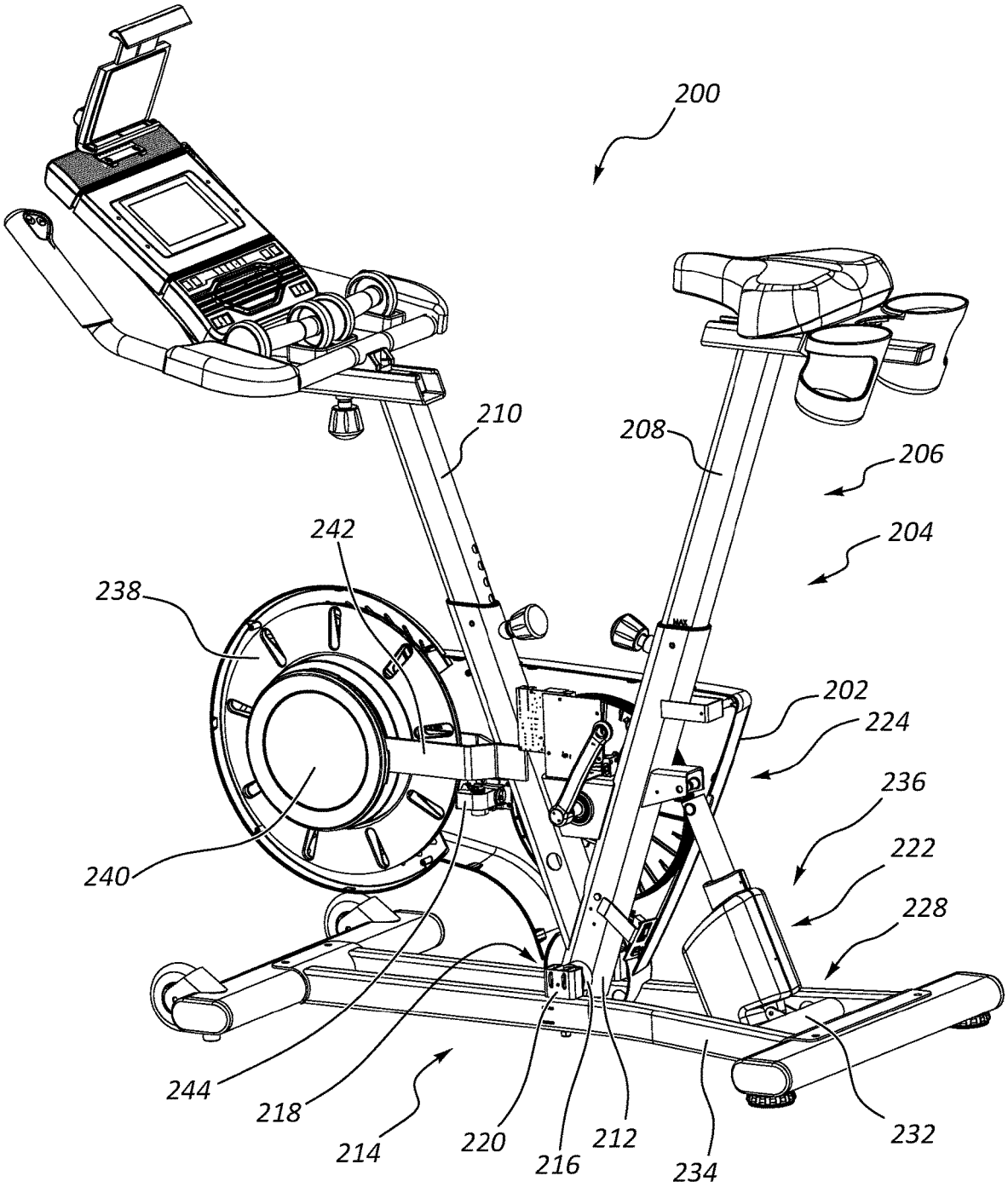
FIG. 2 illustrates a side view of an example of an exercise machine in a recumbent cycling mode accordance with the present disclosure.

FIG. 2 depicts an example of the exercise machine 200 with a portion of the housing 202 removed for illustrative purposes. In this example, the frame 204 includes an upright portion 206 that has a seat member 208 and a console member 210. The seat member 208 and the console member 210 are rigidly connected and form a "Y" shape. In alternative examples, the connection of the console member 210 and the seat member 208 may form a "V" shape," a "T" shape," another kind of shape having a single lower point, or combinations thereof.

In the illustrated example, the upright portion 206 of the frame 204 includes a distal end 212 proximate the base portion 214 of the frame 204. A drop-in axle 216 is located at the distal end 212 of the upright portion 206 of the frame 204. In this example, the drop-in axle 216 includes a first portion that extends beyond a first side of the seat member 208 and a second portion that extends beyond a second side of the seat member 208. The drop-in axle 216 is positioned in a drop-in receptacle 218. In this example, the drop-in receptacle 218 includes a slide bracket 220 into which the drop-in axle can be slid into place. The drop-in receptacle 218 allows the drop-in axle 216 to rotate. In some examples, the drop-in receptacle 218 allows the drop-in axle 216 to freely rotate without limit. In other examples, the drop-in receptacle 218 limits the range that the drop-in axle 216 can rotate.

A tilt actuator 222 may control the range at which the drop-in axle 216 can rotate. In the illustrated example, the tilt actuator 222 includes a first end 224 attached to the upright portion 206. While the illustrated example depicts the first end 224 attached to the seat member 208 of the upright portion 206, the first end 224 may be attached to the console member 210 or another component of the upright portion 206. A second end 228 of the tilt actuator 222 is connected to the base portion 214 of the frame. While the second end 228 is depicted as connected to a cross beam 232 of the base portion, the second end 230 may be connected directly to at least one of the horizontal members 234 or another component of the base portion 214 of the frame 204.

A tilt actuator 222 may control the range at which the drop-in axle 216 can rotate. In the illustrated example, the tilt actuator 222 includes a first end 224 attached to the upright portion 206. While the illustrated example depicts the first end 224 attached to the seat member 208 of the upright portion 206, the first end 224 may be attached to the console member 210 or another component of the upright portion 206. A second end 228 of the tilt actuator 222 is connected to the base portion 214 of the frame. While the second end 228 is depicted as connected to a cross beam 232 of the base portion, the second end 228 may be connected directly to at least one of the horizontal members 234 or another component of the base portion 214 of the frame 204.

The tilt actuator 222 may include an expandable portion 236 located between the tilt actuator's first end 226 and the second end 228. The expandable portion 236 may include a single stage cylinder (single stroke rod), a multiple stage cylinder, a threaded rod, a solenoid, a hydraulic mechanism, a pneumatic mechanism, a magnetic mechanism, a linear actuator, another type of actuator, or combinations thereof.

In the depicted example, the flywheel 238 is on the opposite side of the exercise machine 200 from the tilt actuator 222. In this example, the position of the flywheel 238 reduces the load on the tilt actuator 222 by counter balancing the weight on the upright portion 206 of the frame 102. For example, the loads applied by the weight of the flywheel 238 and the tilt actuator 222 may be balanced about the drop-in axle.

Figure 3:
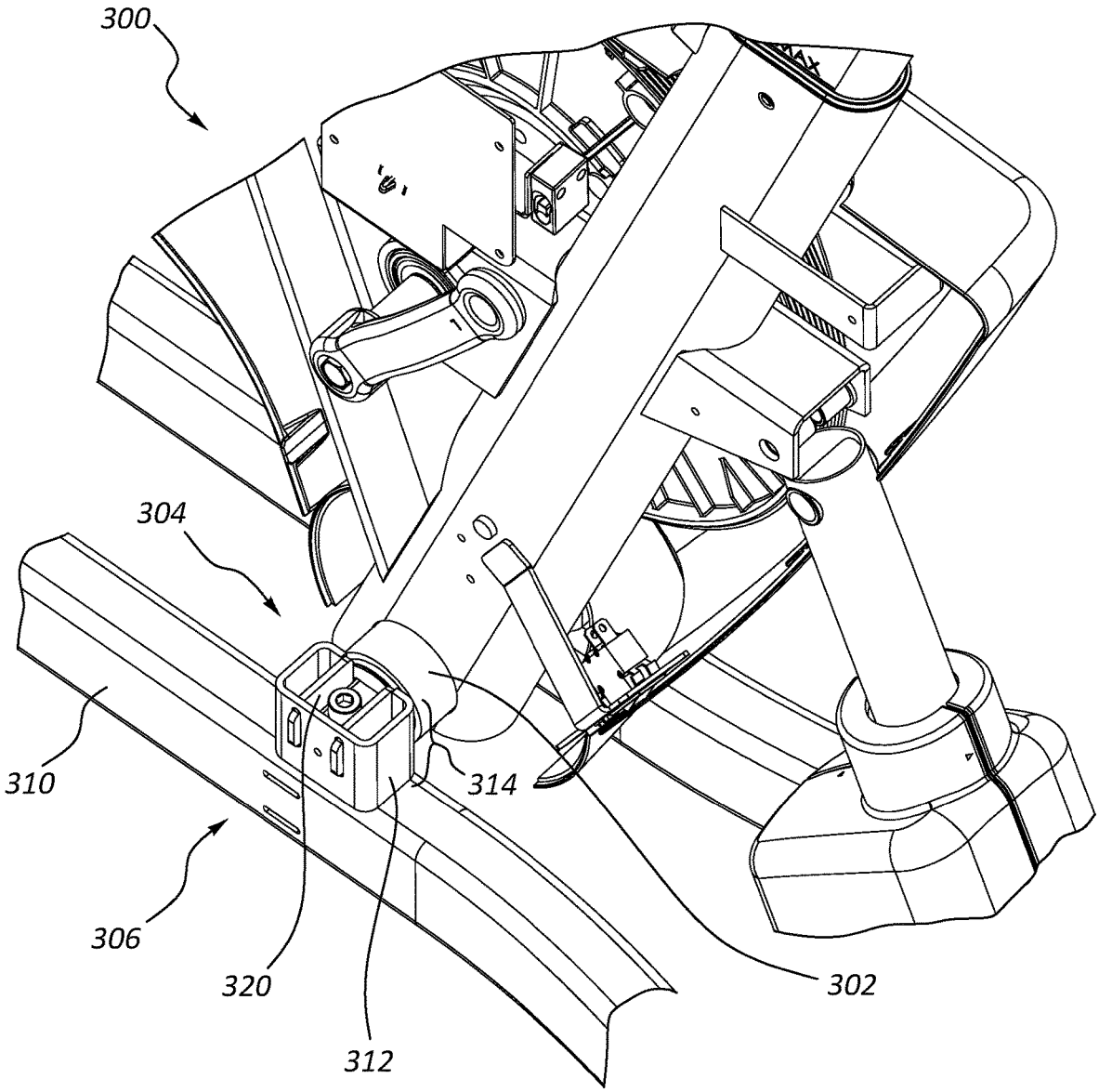
FIG. 3 illustrates a blown-up side view of a portion of an example of an exercise machine in a storage mode accordance with the present disclosure.

FIG. 3 depicts an example of a pivot joint 300. In this example, the pivot joint 300 includes an drop-in axle 302 that is insertable into a drop-in receptacle 304 connected to the base portion 306 of the frame. The drop-in receptacle 304 is attached to the horizontal members 310 of the base portion 306. The drop-in receptacle 304 includes a slide bracket 312 that has a low profile 314. The low profile slide bracket 312 allows for the pivot axis (formed by the pivot joint) to be at a height that is level with, substantially level with, proximate to, or substantially proximate to the horizontal members 310.

The drop-in axle 302 can be slid and/or dropped into the slide bracket 312 by lowering the drop-in axle 302 into a space between the side walls 320 of the slide bracket 312. Once the drop-in axle is inserted into the slide bracket 312, the drop-in axle 302 may be additionally fastened in place, such as through a cap that prevents the drop-in axle 302 from moving upward out of the drop-in receptacle 304.

Figure 4:
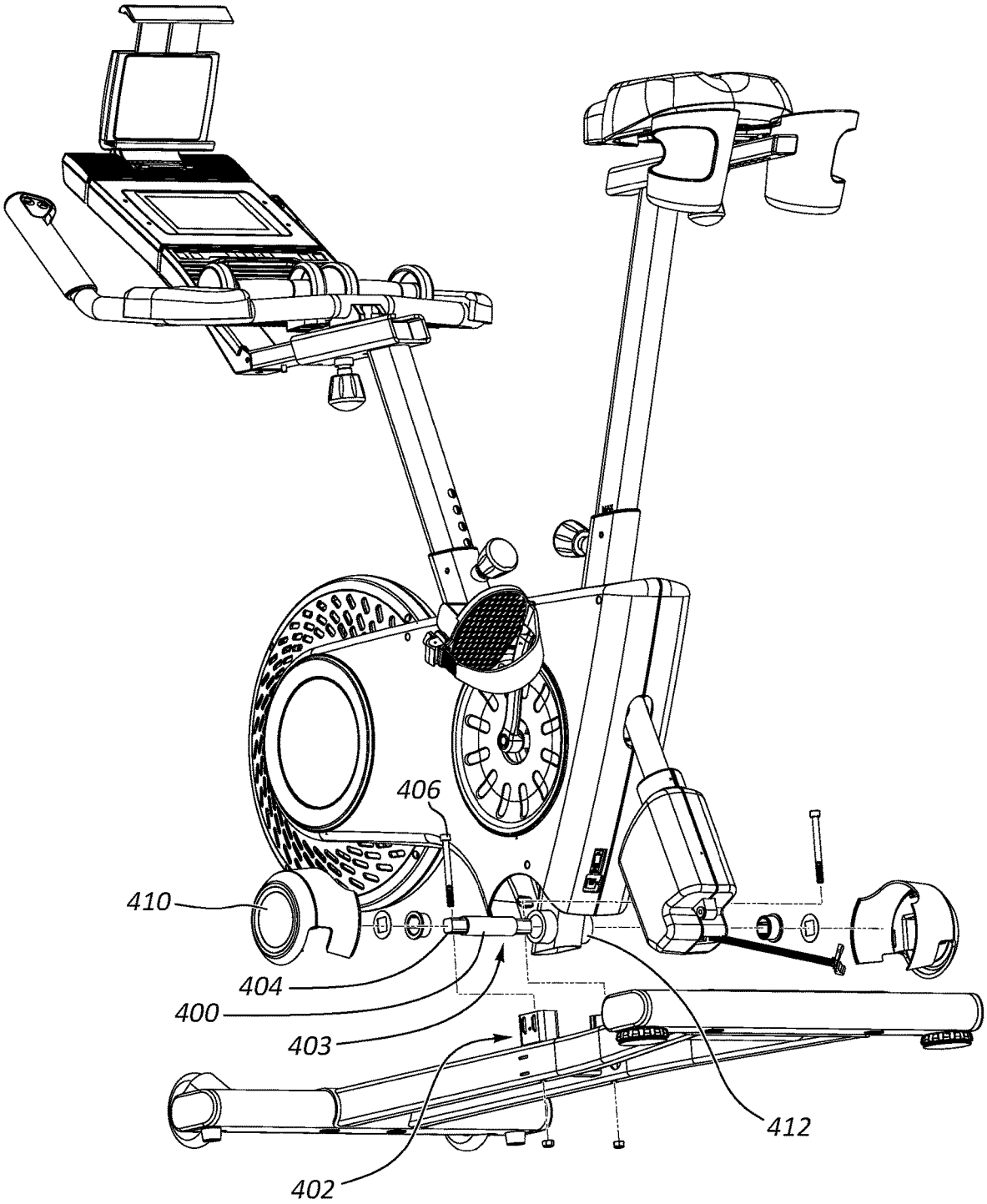
FIG. 4 illustrates an exploded perspective view of an example of an exercise machine in an upright cycling mode accordance with the present disclosure.

FIG. 4 depicts an example of an exploded view of the drop-in axle 403 removed from the drop-in receptacle 402. In this example, the drop-in axle 403 may be lowered into the space defined between the side walls of the slide bracket.

As shown, the drop-in axle 403 includes a stationary portion 404 and a rotatable portion 400. The stationary portion 404 can be secured in place with a fastener 406 when the drop-in axle 403 is received within the drop-in receptacle 402. A pivot housing 410 may be secured on the outside of the drop-in axle 403. In this example, an opening 412 is defined in a member of the upright portion and a mid-section of the drop-in axle is received within the opening during assembly. The ends of the drop-in axle may extend beyond the sides of the frame member. In alternative examples, the drop-in axle may be attached to the outside of the frame member. For example, a first portion of the drop-in axle may be welded to a first side of the frame member, and a second portion of the drop-in axle may be welded to a second side of the frame member. In other examples, the drop-in axle is a single member that is welded to the outside of the frame member.

Figure 5:
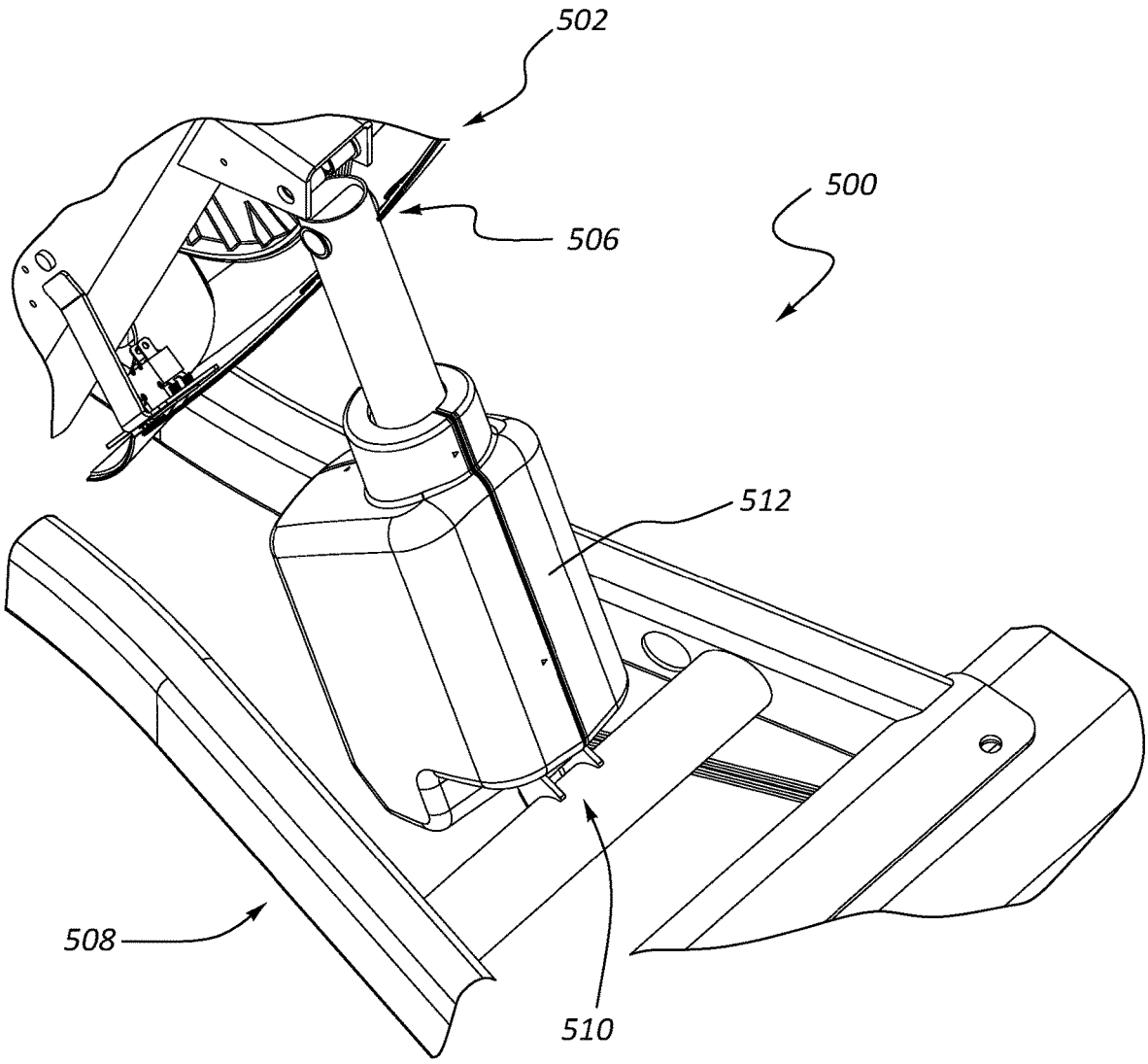
FIG. 5 illustrates a perspective view of an example connection point of an exercise machine in a recumbent mode accordance with the present disclosure.

FIG. 5 depicts an example of a tilt actuator 500. In this example, the tilt actuator 500 is connected to the upright portion 502 of the frame at a first end 506 and connected to the base portion 508 at a second end 510. The tilt actuator 500 includes a housing 512 that includes an internal motor that adjusts the distance between the first and second ends of the tilt actuator 500. The tilt actuator 500 may shorten or extend its length depending on the desired tilt angle.

Figure 6:
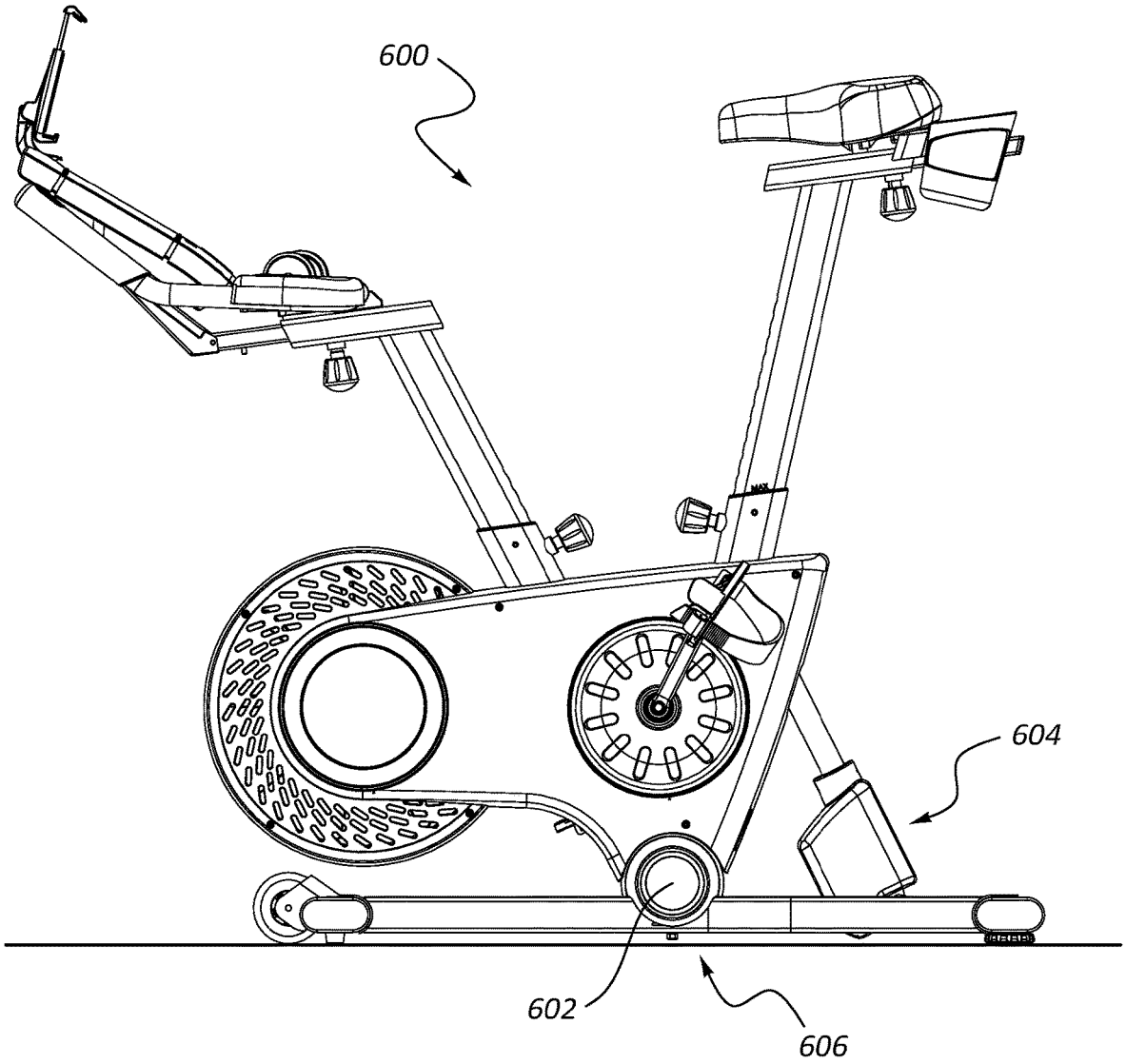
FIG. 6 illustrates a side view of an example of an exercise machine in an upright cycling mode accordance with the present disclosure.

FIG. 6 depicts an example of the upright portion 600 pivoted about the drop-in axle 602. In this example, the tilt actuator 604 is expanded in length so that the upright portion tilts forward. In some examples, the upright portion 600 can pivot about the pivot joint 606 within a pivot range that includes a positive 20 degrees and a negative 20 degrees.

Figure 7:
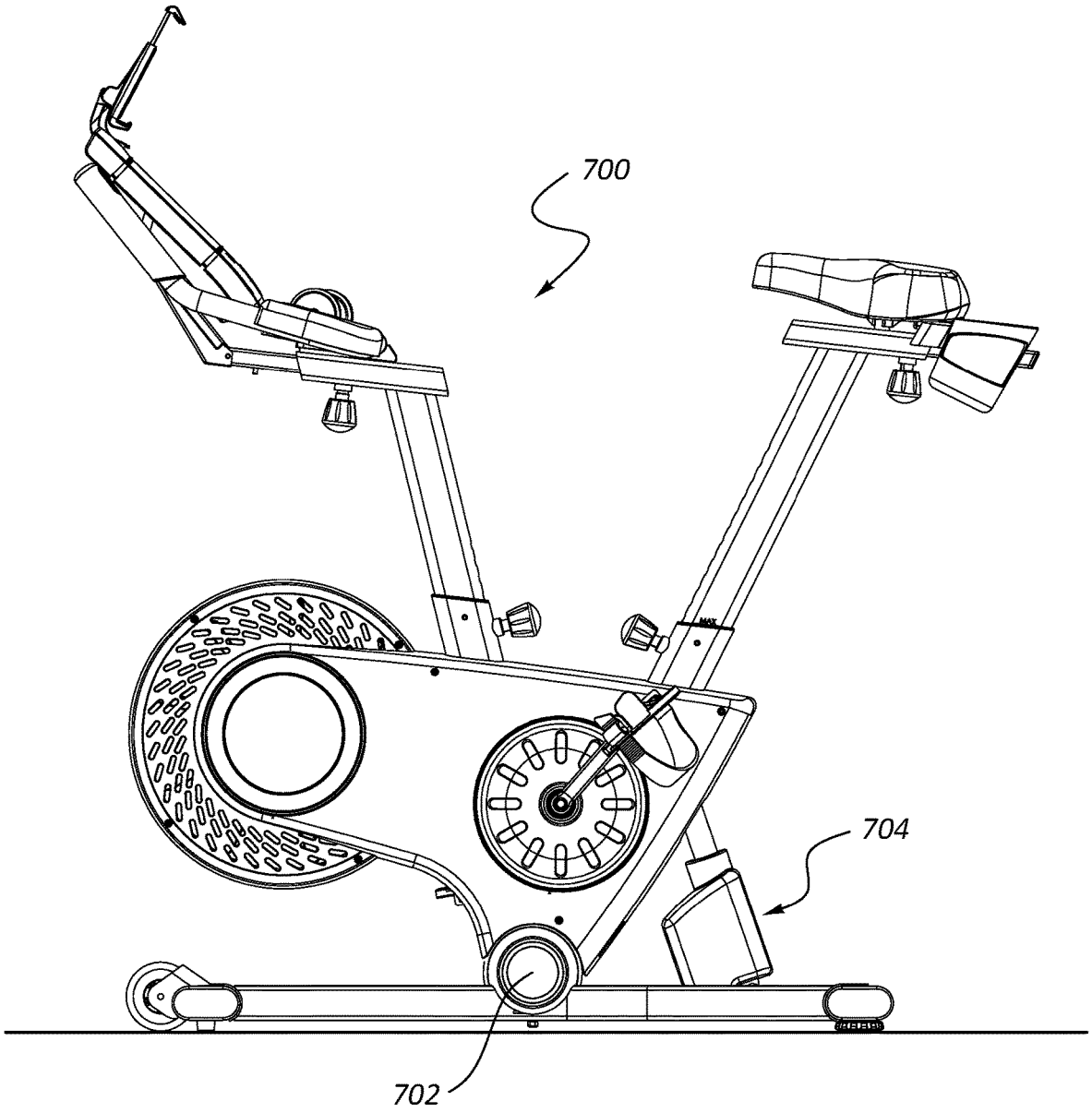
FIG. 7 illustrates a side view of an example of an exercise machine in a recumbent mode accordance with the present disclosure.

FIG. 7 depicts an example of the upright portion 700 pivoted about the drop-in axle 702. In this example, the tilt actuator 704 is shortened in length so that the upright portion tilts backwards.

While the examples above have been described with various members, angles, connection points, and components, any appropriate type and orientation of the members, angles, connection points, components, and so forth may be used in accordance with the principles described herein. Thus, the embodiments above manifest just some of the examples of the invention and do exclusively depict all possible embodiments of the invention.

General Description

In general, the invention disclosed herein may provide the user with an exercise machine that can pivot about a single pivot joint to change the difficulty of an exercise performed on the exercise machine. In some cases, the exercise machine is a stationary bike. The principles described herein may apply to any appropriate exercise machine. For example, a non-exhaustive list of exercise machines that may be compatible with the principles described herein include a stationary bicycle, an elliptical trainer, a stepper machine, a rowing machine, a treadmill, another type of machine, or combinations thereof.

In one example, the exercise machine may include a frame member. An upright portion of the exercise machine's frame may be pivotally attached to the base portion of the frame so that the upright portion can tilt in a forward direction or in a backward direction. In some examples, the upright portion of the exercise machine may tilt forward at least a positive 20 degrees. In another example, the upright portion may tilt forward at least a positive 15 degrees. In yet another example, the upright portion may tilt forward at least a positive 10 degrees. Additionally, the upright portion may tilt forward at least a positive 5 degrees. In some examples, the upright portion of the exercise machine may tilt backward at least a negative 20 degrees. In another example, the upright portion may tilt backward at least a negative 15 degrees. In yet another example, the upright portion may tilt backward at least a negative 10 degrees. Additionally, the upright portion may tilt backward at least a negative 5 degrees.

The upright portion of the frame may include a seat member and a console member. In some examples, the seat member and the console member are attached to one another. In some cases, the seat member and the console member are rigidly connected and form a "Y" shape. In alternative examples, the connection of the console member and the seat member may form a "V" shape," a "T" shape," another kind of shape with a single lower connection point, or combinations thereof. In another example, the seat member and the console member are independent of one another.

A seat may be attached to the seat member. Any appropriate type of seat may be attached to the seat member. In some cases, the seat includes handles, a backrest, a water holder, padding, other features, or combinations thereof. The seat may position the user so that the user can sit in an upright position where the seat is positioned above the crank assembly. In other examples, the seat is positioned so that the seat is laterally positioned with respect to the crank assembly thereby allowing the user to pedal in a recumbent position. In some cases, the seat height is adjustable.

A console may be connected to the console member. In some cases, a handle is attached to the console member. The height of the console member may be adjustable. In some situations, no console is connected to the console member. In these types of examples, at least one handle, a work station, a water holder, a mobile device holder, a display, an input station, or another feature may be connected to the console member.

At least some of the frame's upright portion is covered by a housing that hides at least some of the internal components of the exercise machine. In this example, a rotary resistance mechanism can be disposed in the housing and is attached to a crank assembly. The rotary resistance mechanism may include a flywheel and a magnetic unit positioned proximate the flywheel that resists the movement of the flywheel. The crank assembly includes a crank axle connected to a first crank arm and a second crank arm. During the performance of an exercise on the exercise machine, a user pushes against a first pedal connected to the first crank arm and a second pedal connected to the second crank arm. The crank assembly may be attached to the console member, the seat member, another component of the upright portion, or combinations thereof.

The crank assembly may be connected to a resistance mechanism. In some examples, a transmission connects the crank axle to the resistance mechanism. Thus, as the crank assembly rotates, the transmission transfers a resistive force from the resistance mechanism to the crank assembly. The resistance mechanism may include a flywheel that is proximate a magnetic unit which resists the movement of the flywheel. In examples where the magnetic unit exhibits a consistent magnetic field, the amount of resistance applied to the flywheel may be changed by moving the magnetic unit towards or away from the flywheel. For example, the resistance applied to the flywheel may be increased by moving the magnetic unit closer to the flywheel. In other examples, the resistance applied to the flywheel may be decreased by moving the magnetic unit closer to the flywheel. In some cases, the magnetic unit may emit a variable amount of magnetic resistance by applying a varying amount of electrical power to the magnetic unit. While this example has been described with reference to a resistance mechanism that includes a flywheel and a magnetic unit, any appropriate type of resistance unit may be used in accordance with the principles described herein. A non-exhaustive list of resistance mechanisms that may be used include an air resistance mechanism, a fan, a hydraulic mechanism, a pneumatic mechanism, another type of resistance mechanism, or combinations thereof.

The upright portion of the frame may be connected to the base portion of the frame at a pivot joint. The pivot joint includes a drop-in axle that is removably attached to a drop-in receptacle. A tilt actuator may connect the base portion of the frame to the upright portion of the frame. The flywheel may be located on a far side of the exercise machine away from the tilt actuator and is a counter weight on the other side of the pivot joint to the tilt actuator.

In some cases, the upright portion of the frame includes a distal end proximate the base portion of the frame, and a drop-in axle is located at the distal end of the upright portion of the frame. In this example, the drop-in axle may include a first portion that extends beyond a first side of the seat member and a second portion that extends beyond a second side of the seat member. The drop-in axle can be positioned in and secured to a drop-in receptacle.

Any appropriate type of drop-in receptacle may be used in accordance with the principles described herein. In one example, the drop-in receptacle includes a slide bracket into which the drop-in axle can be slid into place. In another example, the drop-in receptacle includes a slot defined in at least one of a horizontal frame member, a cross bar of the base portion, another part of the base portion, or combinations thereof. In an example, the drop-in receptacle includes a trough defined in a component of the base portion.

Any appropriate type of base portion may be used in accordance with the principles described herein. For example, the base portion may include a first horizontal member and a second horizontal member aligned with the first horizontal member. Each of the first and second horizontal frame members may connect a front cross bar of the base portion to a rear cross bar of the base portion. In some cases, at least one of the front cross bar and the rear cross bar may include a least one wheel to assist with moving the exercise machine across a support surface. At least one of the first horizontal member, the second horizontal member, the front cross bar, the rear cross bar, another cross bar, or combinations thereof may include a gripping feature that stabilizes the exercise machine when positioned to perform an exercise.

The drop-in receptacle may secure to the first horizontal member, the second horizontal member, the front cross bar, the rear cross bar, another cross bar, another component of the base portion, or combinations thereof. In one particular embodiment, the drop-in receptacle is transversely oriented with respect to the length of the horizontal members and connected to both the first and second horizontal members. In some cases, the drop-in receptacle is attached in a middle region of the horizontal members.

The components of the drop-in receptacle may be covered in a pivot housing. The pivot housing may be a separate housing than the housing that covers a significant amount of the upright portion of the frame, the resistance mechanism, or combinations thereof. The pivot housing may prevent debris and other objects may coming into contact with the components of the pivot joint. In those examples where grease is used to lubricate the components of the pivot joint, the housing can assist with retaining the grease or other lubricant and assist with keeping the lubricant clean.

In some cases, the drop-in receptacle allows the insertable axle to rotate. In some examples, the drop-in receptacle allows the insertable axle to freely rotate without limit. In other examples, the drop-in receptacle limits the range that the insertable axle can rotate.

In other examples, the drop-in axle does not rotate with respect to the base portion of the frame. In certain embodiments, a sleeve surrounds the drop-in axle. In these embodiments, the drop-in axle may be fixed in place while still allowing the sleeve to rotate about the drop-in axle. In other cases, the distal end of the frame members of the upright portion are rotationally isolated with respect to the drop-in axle. As a result, the drop-in axle may be held stationary with respect to the base portion while the upright portion of the frame rotates about the drop-in axle.

A tilt actuator may control the range at which the upright portion can rotate. The tilt actuator may include a first end attached to the upright portion. While the examples described above include that the first end attached to the seat member of the upright portion, the first end may be attached to the console member or another component of the upright portion. A second end of the tilt actuator is connected to a base portion of the frame. While the second end is depicted as connected to a cross beam of the base portion, the second end may be connected directly to at least one of the horizontal members or another component of the base portion of the frame.

The tilt actuator may include an expandable portion located between the tilt actuator's first end and the second end. The expandable portion may include a single stage cylinder (single stroke rod), a multiple stage cylinder, a threaded rod, a solenoid, a hydraulic mechanism, a pneumatic mechanism, a magnetic mechanism, a linear actuator, another type of actuator, or combinations thereof.

In the some examples, the resistance mechanism may resist movement of the first and second crank arms during the performance of the exercise. The flywheel may be attached to a flywheel axle that is connected to the console member of the upright portion through a flywheel bracket, and the flywheel may rotate about the flywheel axle. The rotation of the flywheel is resisted with a magnetic unit. The strength of the magnetic flux imposed on the flywheel may be adjustable by either changing the position of the magnetic unit or changing a level of electric power that changes the magnetic strength.

In some cases, the flywheel is on the opposite side of the exercise machine from the tilt actuator. The position of the flywheel may reduce the load on the tilt actuator by counter balancing the weight on the upright portion of the frame. For example, the loads applied with the weight of the flywheel and the tilt actuator may be balanced about the pivot joint. With the counter weight loaded to the pivot joint, the tilt actuator can be constructed to handle loads where the tilt actuator is under a tensile load rather that predominately under compressive loads. Under a tensile load, the tilt actuator does not have to generate a force that sufficiently moves the weight of the upright portion, as gravity on the flywheel generates the force sufficient to move the upright portion of the exercise machine. Rather, the tilt actuator resists the pull force of the flywheel rather than generating it.

In some examples, the pivot axis is within less than six inches away from the horizontal member of the base portion. Keeping the pivot axis close to the horizontal member provides a longer moment arm about which the tilt actuator can move the upright portion, which lowers the load needed to move or prevent movement of the upright portion.

In examples with a console, the console may include a pair of handles that the user may grip during the performance of an exercise. The console may include a display screen that indicates at least one operating parameter of the exercise machine or a physiological parameter of the user during the workout. For example, the display screen may depict the settings of the resistance mechanism, the speed at which the user is operating the exercise machine, the current exercise mode of the exercise machine, the estimated calories of the user's workout, the user's heart rate, the time of day, the time duration of the workout, other operating parameters, other physiological parameters of the user, or combinations thereof. In some examples, the calories burned estimate may be based on information gathered from the exercise machine's operating parameters. In some cases, at least some of the information used to determine the calorie burn is based on a user profile that contains personal information about the user, such as height, weight, age, gender, health conditions, body composition, other types of personal information, or combinations thereof. The personal information may inputted into the console of the exercise machine. In other examples, the console may be in communication with a remote device that contains the user profile. For example, the console may be in wireless communication with a personal computer, a mobile device, a datacenter, a website, a network device, another type of device, or combinations thereof that contain at least one item of personal information about the user.

In some examples, the console may be in communication with a remote device that operates a fitness tracking program. In type of example, some of the personal information may be received from the fitness tracking program. Also, in some cases, the console may send information about the user's workout to the fitness tracking program. This workout information may include the type and duration of the exercise, the resistance settings, the estimated number of calories burned, other types of information, or combinations thereof.

The console may also include at least one input mechanism for inputting information into the console. For example, the user may control the operating parameters of the exercise machine with the console. In some cases, the user can control the resistance settings of through the console. Also, the user may raise and lower the seat through commands inputted through the console. Additionally, in some examples, the user can control the position of the console member through the console and/or control the console tilt angle through the console. The input mechanism of the console may include a button, lever, dial, touch screen, key board, microphone, another type of input mechanism, camera, or combinations thereof. In some examples, the user may command the exercise machine to change from one exercise mode to another. In this type of an example, the exercise machine may change the seat position, the console tilt angle, the console member position, any other positions to put the exercise machine in the desired exercise mode or storage mode without further input from the user.

What is claimed is:

1. An exercise machine, comprising:

a frame, the frame including:

a base portion;

an upright portion coupled to the base portion at a single pivot point;

a pivot joint connecting the upright portion to the base portion at the single pivot point;

the pivot joint, including:

a drop-in axle connected to the upright portion, wherein the drop-in axle includes a stationary portion and a rotatable portion; and a drop-in receptacle connected to the base portion;

wherein the drop-in axle is removably received in the drop-in receptacle, wherein the stationary portion is secured to the drop-in receptacle with a fastener transverse to a pivot axis of the drop-in axle.

2. The exercise machine of claim 1, further comprising:

a movable element attached to the frame, wherein the movable element moves with respect to the frame during a performance of an exercise.

3. The exercise machine of claim 2, wherein the movable element includes a crank assembly connected to the upright portion, the crank assembly comprising:

a crank axle;

a first crank arm attached to a first side of the crank axle; and a second crank arm attached to a second side of the crank axle.

4. The exercise machine of claim 3, further comprising:

a housing that covers at least a portion of the crank axle;

wherein the drop-in axle is located outside of the housing.

5. The exercise machine of claim 3, wherein the crank axle is separate from the drop-in axle.

6. The exercise machine of claim 2, further comprising a flywheel that resists movement of the movable element during the performance of the exercise.

7. The exercise machine of claim 6, further comprising a tilt actuator that connects the base portion of the frame to the upright portion of the frame and determines an angle that the upright portion forms with respect to the base portion.

8. The exercise machine of claim 7, wherein the flywheel is located on a far side of the exercise machine away from the tilt actuator and is a counter weight to the tilt actuator.

9. The exercise machine of claim 1, wherein the upright portion of the frame is pivotable about the drop-in axle;

wherein the upright portion has a pivot range that is within negative 20 degrees and positive 20 degrees.

10. The exercise machine of claim 1, wherein the exercise machine comprises a stationary bicycle.

11. The exercise machine of claim 1, wherein the drop-in receptacle comprises a slide bracket.

12. The exercise machine of claim 1, wherein the base portion comprises a horizontal frame member and the drop-in receptacle is mounted directly to the horizontal frame member.

13. The exercise machine of claim 1, wherein the upright portion comprises:

a seat frame member; and a console frame member connected to the seat frame member;

wherein the seat frame member and the console frame member form a V shape.

14. The exercise machine of claim 1, wherein a top portion of the drop-in receptacle is open.

15. An exercise machine, comprising:

a frame including a base portion, an upright portion coupled to the base portion, and a pivot joint connecting the upright portion to the base portion;

wherein the pivot joint includes a drop-in axle connected to the upright portion;

a first drop-in receptacle and a second drop-in receptacle connected to the base portion, wherein both the first drop-in receptacle and the second drop-in receptacle include a plurality of side walls, wherein the drop-in axle is removably received in both the first drop-in receptacle and the second drop-in receptacle between the plurality of side walls, wherein a top portion of the first drop-in receptacle, the second drop-in receptacle, or both the first drop-in receptacle and the second drop-in receptacle is open;

a movable element that moves with respect to the frame during a performance of an exercise;

wherein the movable element includes a crank assembly connected to the upright portion;

the crank assembly including:

a crank axle;

a first crank arm attached to a first side of the crank axle; and a second crank arm attached to a second side of the crank axle.

16. The exercise machine of claim 15, further comprising a flywheel that resists movement of the movable element during the performance of the exercise.

17. The exercise machine of claim 16, further comprising a tilt actuator that connects the base portion of the frame to the upright portion of the frame and determines an angle that the upright portion forms with respect to the base portion.

18. The exercise machine of claim 17, wherein the flywheel is located on a far side of the exercise machine away from the tilt actuator and is a counter weight to the tilt actuator.

19. An exercise machine, comprising:

a frame including a base portion, an upright portion coupled to the base portion, and a pivot joint connecting the upright portion to the base portion;

wherein the pivot joint includes:

a drop-in axle connected to the upright portion, wherein the drop-in axle includes a stationary portion and a rotatable portion; and a drop-in receptacle connected to the base portion, wherein the drop-in receptacle includes a plurality of side-walls;

wherein the drop-in axle is removably received in the drop-in receptacle, and wherein the stationary portion is secured to the drop-in receptacle using a fastener transverse to a pivot axis of the drop-in axle;

a movable element that moves with respect to the frame during a performance of an exercise;

wherein the movable element includes a crank assembly connected to the upright portion;

the crank assembly including:

a crank axle;

a first crank arm attached to a first side of the crank axle; and a second crank arm attached to a second side of the crank axle;

a flywheel that resists movement of the movable element during the performance of the exercise;

a tilt actuator that connects the base portion of the frame to the upright portion of the frame and determines an angle that the upright portion forms with respect to the base portion; and wherein the flywheel is located on a far side of the exercise machine away from the tilt actuator and is a counter weight to the tilt actuator.

* * * * *